US008337078B2

(12) United States Patent
Mignot et al.

(10) Patent No.: US 8,337,078 B2
(45) Date of Patent: Dec. 25, 2012

(54) MAGNETIC PROTECTION FOR A TIMEPIECE BALANCE SPRING

(75) Inventors: Jean-Pierre Mignot, Areuse (CH); Jean-Jacques Born, Morges (CH)

(73) Assignee: The Swatch Group Research and Development Ltd, Marin (CH)

( * ) Notice: Subject to any disclaimer, the term of this patent is extended or adjusted under 35 U.S.C. 154(b) by 217 days.

(21) Appl. No.: 12/857,075

(22) Filed: Aug. 16, 2010

(65) Prior Publication Data

US 2011/0038234 A1 Feb. 17, 2011

(30) Foreign Application Priority Data

Aug. 17, 2009 (EP) ..... 09168003

(51) Int. Cl.
*G04B 43/00* (2006.01)

(52) U.S. Cl. ..... 368/293; 368/175

(58) Field of Classification Search ..... 368/293, 368/175, 286
See application file for complete search history.

(56) References Cited

U.S. PATENT DOCUMENTS

| | | | | | |
|---|---|---|---|---|---|
| 2,350,838 | A | * | 6/1944 | Straumann | 368/171 |
| 2,724,235 | A | * | 11/1955 | Bauerle | 368/126 |
| 3,002,138 | A | * | 9/1961 | Byrnes et al. | 318/132 |
| 3,184,910 | A | * | 5/1965 | Laviolette | 368/175 |
| 3,335,561 | A | * | 8/1967 | Kurosawa | 368/158 |
| 3,919,836 | A | * | 11/1975 | Nishizawa | 368/293 |
| 3,943,701 | A | | 3/1976 | Poix | |

FOREIGN PATENT DOCUMENTS

DE 196 51 320 A1 6/1998

* cited by examiner

*Primary Examiner* — Sean Kayes
(74) *Attorney, Agent, or Firm* — Sughrue Mion, PLLC

(57) ABSTRACT

The device for protecting a timepiece balance spring (1) from stray magnetic fields includes at least one disc (2) with high magnetic permeability, arranged in a parallel plane to the plane of the balance spring, wherein the disc (2) and the balance spring are mounted coaxially with each other.

5 Claims, 6 Drawing Sheets

MAGNETIC PROTECTION FOR A TIMEPIECE BALANCE SPRING

The present invention relates to a device for protecting a timepiece balance spring against stray or parasitic magnetic fields originating from outside said timepiece.

Devices have already been proposed for protecting a timepiece against the disturbing influence of external magnetic fields of any nature, for example permanent magnets or electric motors of any type.

The simplest and also most radical solution consists in completely shielding the timepiece movement so that no disturbing field line can penetrate it. This is the case proposed by CH Patent No. 122391, wherein the watch movement is protected by a set of elements formed of a highly permeable, rustproof alloy with low hysteresis, which forms a magnetic screen. The elements are: a dome arranged between the movement and back cover of the watch, a dust cover ring forming a calotte arranged between the movement, and a casing ring and intermediate plate, arranged between the bottom plate and dial of the watch. This system is extremely heavy and expensive. Indeed, it requires three additional parts which not only make the watch heavier but also increase the volume thereof.

A lighter and more compact solution than that proposed above is disclosed in FR Patent No. 1,408,872. Here, the watch movement is not completely surrounded by a highly permeable material, but only the back cover and periphery of the watch. The device is thus formed by a case element that is sufficiently impermeable to magnetic fields, and the case element is completed by a soft steel casing ring with which it forms a dome that covers the movement and forms a magnetic screen. The case element is formed by the back cover of the case, made of a polishable, rustproof alloy with a homogenous ferritic structure. Thus, in this embodiment, no extra parts are added, since the back cover and the casing ring are made directly in materials with high magnetic permeability. Moreover, there is no screen between the movement and the watch dial, since the protective device is limited to a dome with no cap that acts as a housing for the watch movement.

The material forming the balance spring is generally made of a metal alloy, such as steel capable of residual magnetisation if it is subjected to an external magnetic field. The excellent mechanical qualities of the steel (ductibility, elasticity, heat expansion coefficient, etc.) largely compensate for this drawback. It must therefore be protected from these interfering fields. It the movement is subjected to a 4.8 kA/m field, the variation of rate must not exceed 30 seconds per day to comply with horological standards. Without protection, this variation may be sensitive and reach significant variations, of up to several minutes per day. This variation of rate is due above all to the longitudinal magnetisation of the coils forming the balance spring, which produces torque on the balance staff to which the balance spring is connected. The torque is added to or subtracted from the normal mechanical torque. The variation of rate is also influenced, but to a lesser extent, by the phenomenon of magnetostriction that tends to lengthen or shorten the band forming the balance spring when it is subjected to a magnetic field.

It will be seen that there is a certain analogy between the solution proposed by the aforementioned FR Patent No. 1,408,872 and the solution of the present invention. In this document however, the actual balance spring is not protected against a stray field whatever the orientation of the field prevailing in the balance spring plane. Indeed, since the balance spring is off-centre relative to the centre of the movement, and if omni-directional protection is desired, a device is proposed that is centred relative to said balance spring and not relative to the movement as a whole, as is the case of the aforecited document.

This object is achieved by the present invention, which not only conforms to the statement of the first paragraph above, but is original in that the protective device includes at least one disc with high magnetic permeability, arranged in a parallel plane to the plane of the balance spring, and the disc and the balance spring are mounted coaxially with each other.

The invention will now be explained in detail below via several embodiments given by way of non-limiting example, and these embodiments are illustrated by the annexed drawings, in which.

Figure 3A:
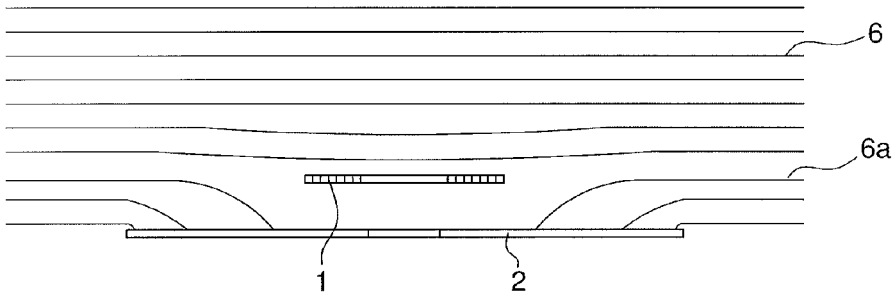
Figure 3B:
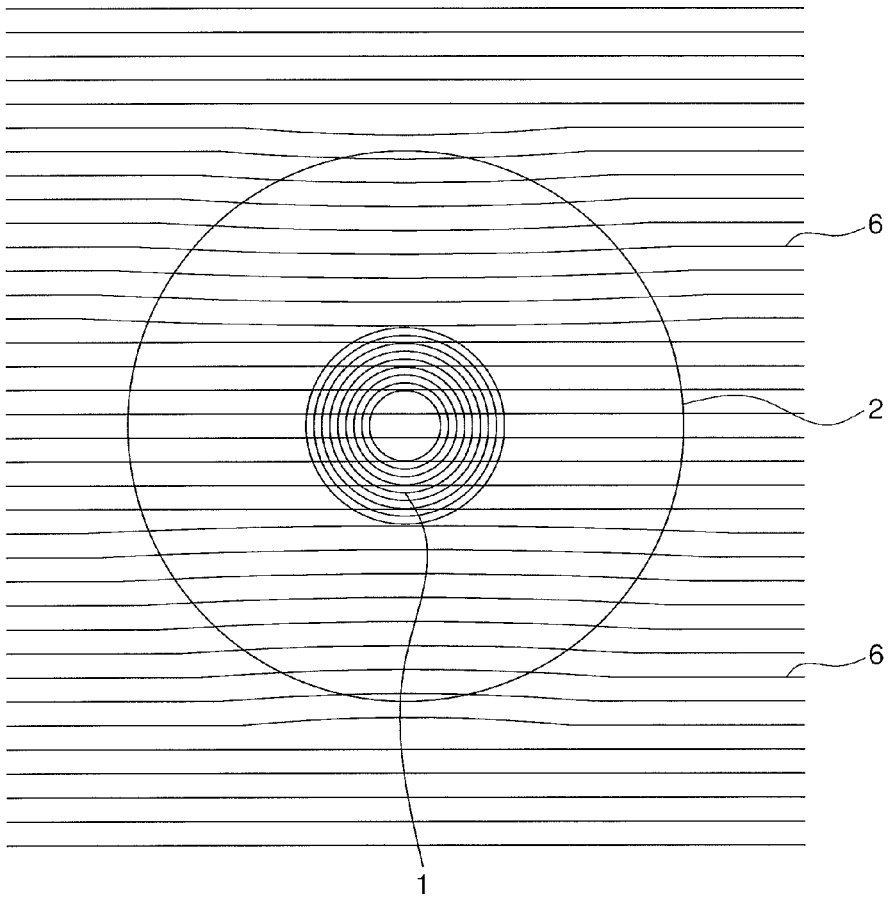
Figure 4A:
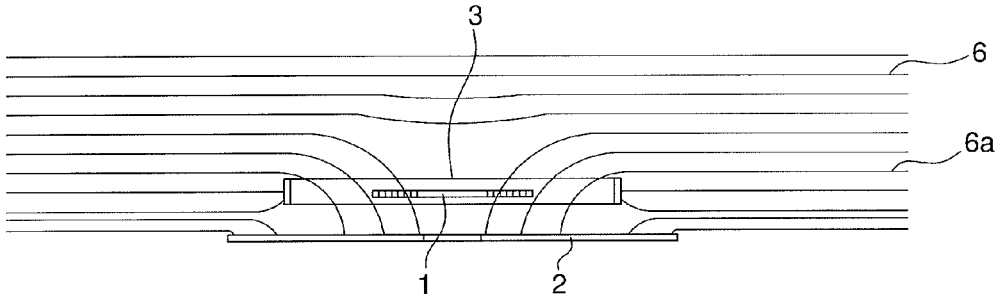
Figure 4B:
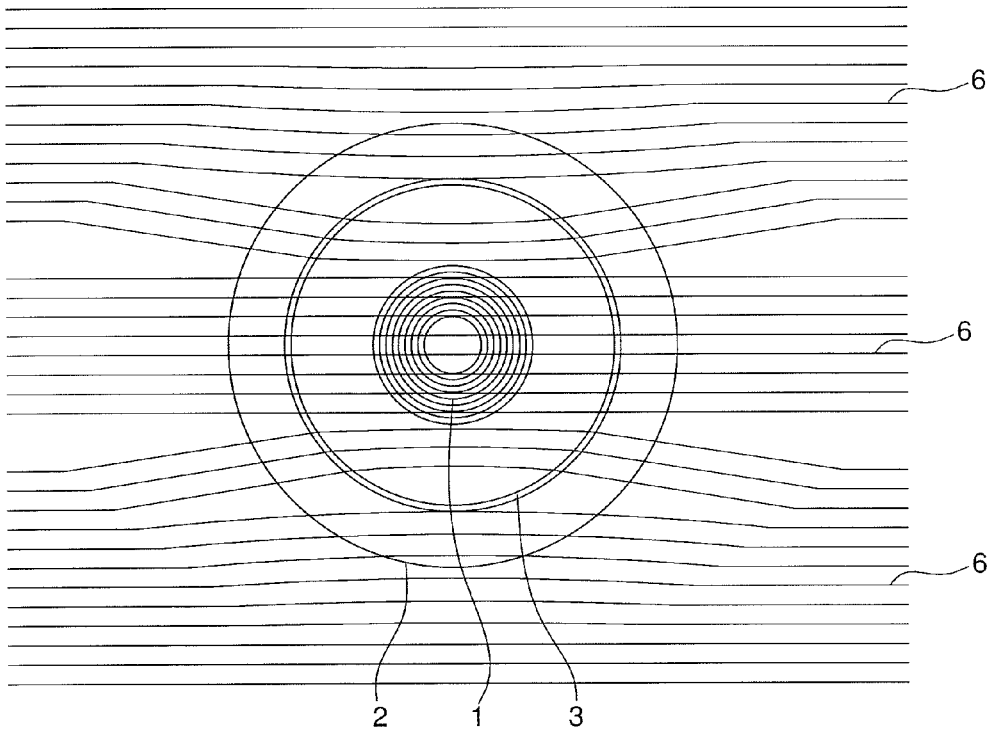
Figure 5A:
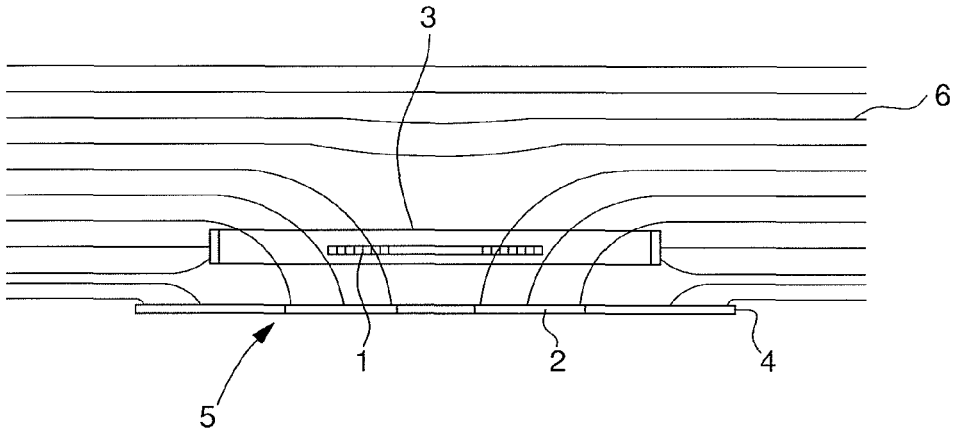
Figure 5B:
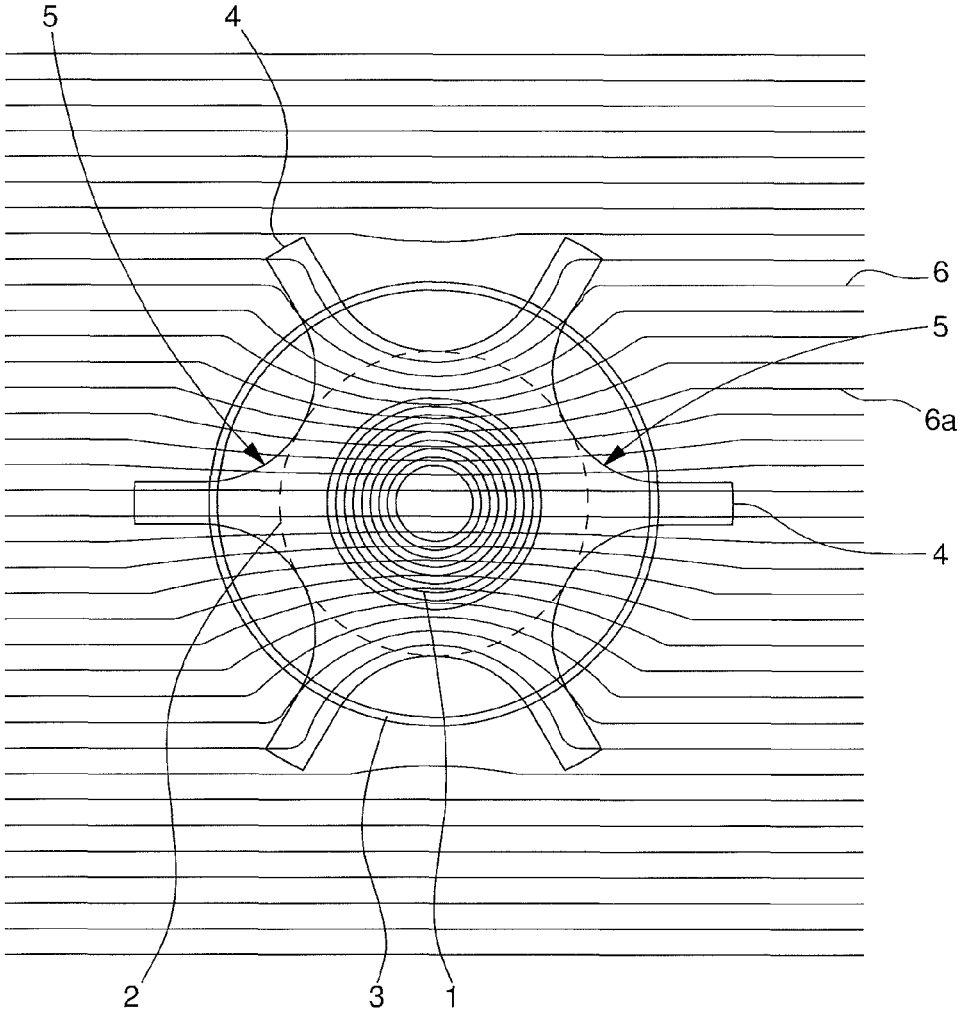
Figure 6:
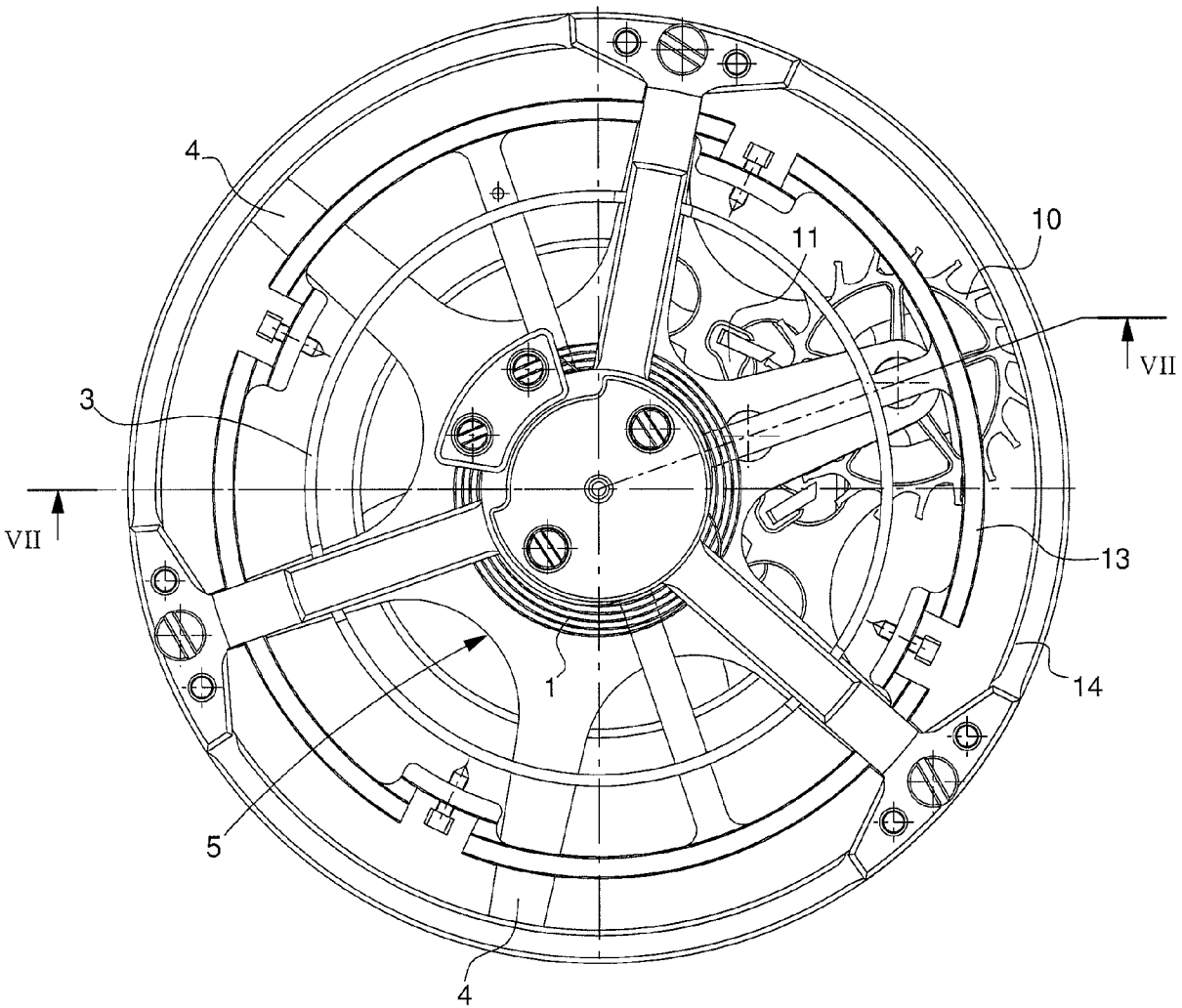
Figure 7:
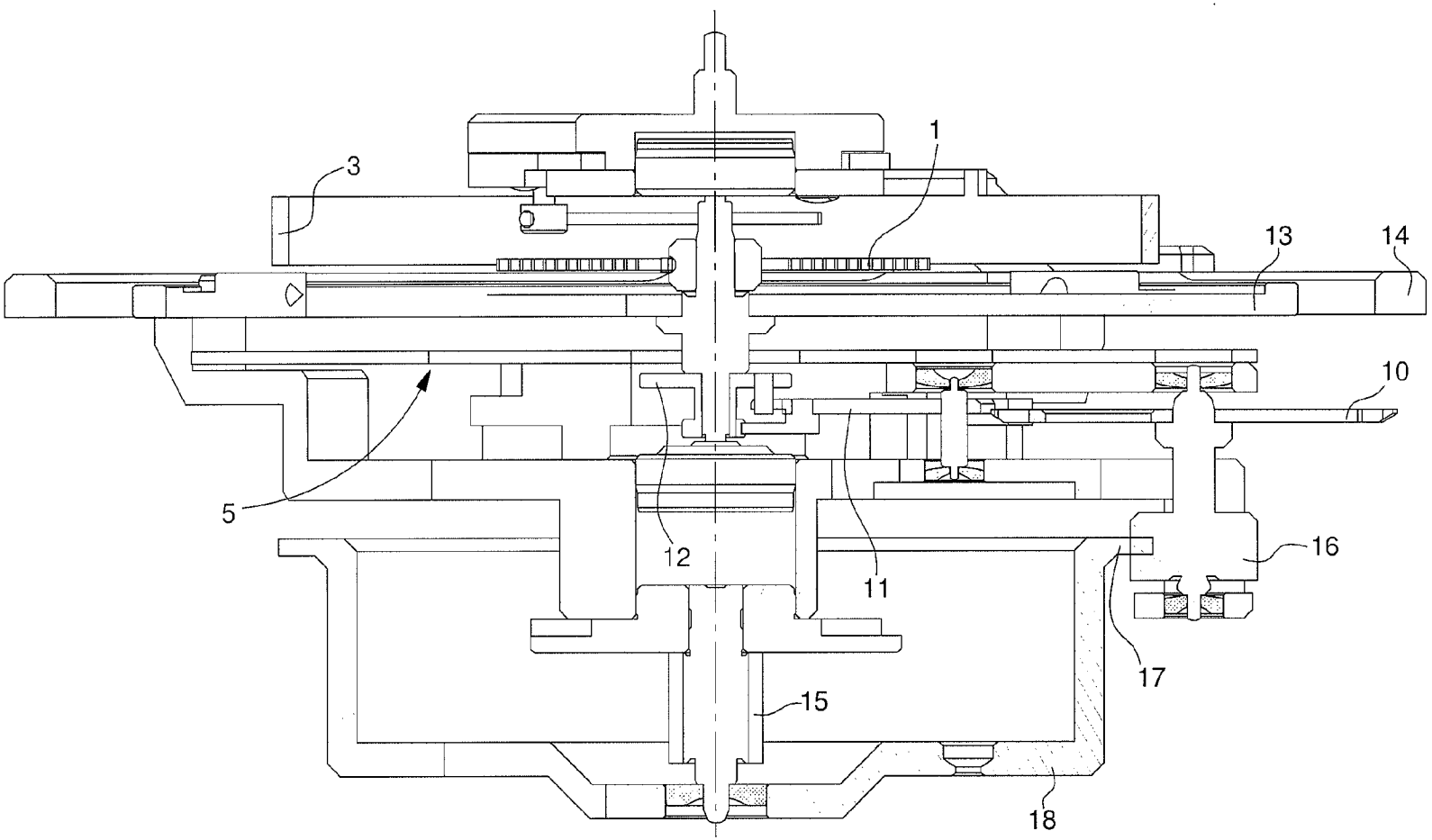

FIGS. 3*a* and 3*b* are schematic cross-sectional and plan views of a first embodiment of the invention;

FIGS. 4*a* and 4*b* are schematic cross-sectional and plan views of a second embodiment of the invention;

FIGS. 5*a* and 5*b* are schematic cross-sectional and plan views of a third embodiment of the invention;

FIG. 6 is a plan view of the third embodiment of the invention applied to a tourbillon, and FIG. 7 is a cross-section along the line VII-VII of FIG. 6.

Figure 1:
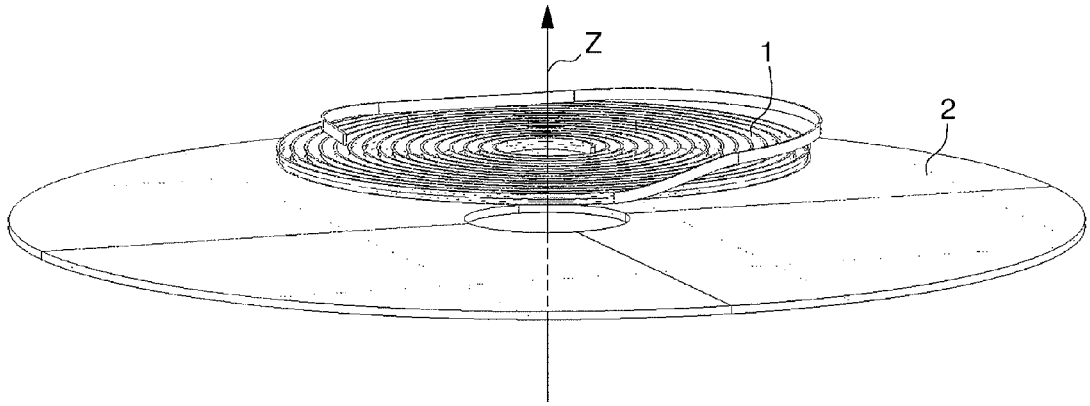
FIG. 1 is a schematic, perspective view of a first embodiment of the invention.

The schematic and perspective view of FIG. 1 is a simplified way of showing the device according to the invention for protecting against stray magnetic fields originating from outside the timepiece. The device thus includes at least one disc 2 with high magnetic permeability, arranged in a parallel plane to the plane of balance spring 1, which is fitted to the timepiece. FIG. 1 also shows that disc 2 and balance spring 1 are mounted coaxially with each other around an axis symbolised by the letter Z.

Rather than attempting to decrease or totally remove the stray magnetic field from the balance spring, as indicated in the first document cited above (CH 122 391) and then proposing heavy or cumbersome solutions, as seen above, it seems to us wiser to orientate or deviate this stray magnetic field without necessarily decreasing or removing it, in directions where it is less effective from the point of view of its potential to polarise the magnetic material forming the balance spring.

Figure 2:
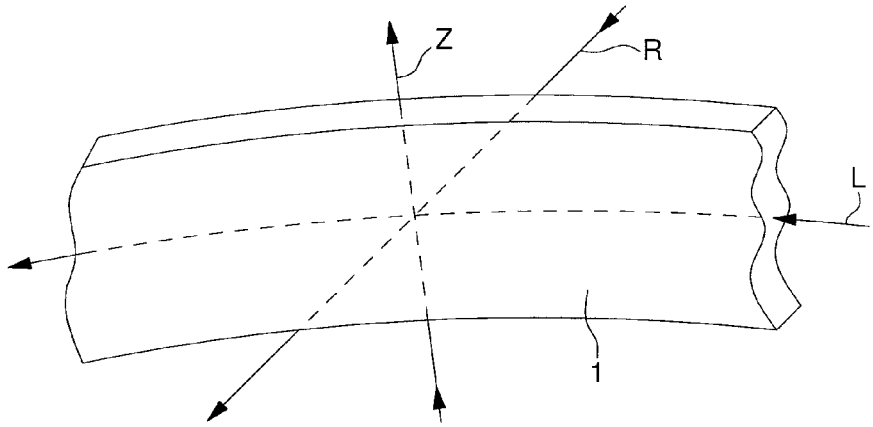
FIG. 2 shows a portion of the balance spring shown in FIG. 1.

FIG. 2 shows a portion of this balance spring 1, which is a very long band wound around itself. The band is of reduced height and very small thickness. This means that if it is polarised in the direction of height Z or orthogonally, or even in the direction of thickness R or radially, little or no residual magnetisation will remain. However, polarisation in the direction of length L should be avoided, since it is the only polarisation, especially on the external coils of the balance spring, which will cause residual magnetisation therein, generating, as seen above, an additional disturbing torque causing random variation in the return torque of the balance spring, which affects the isochronism of the regulating system. To prevent or decrease this longitudinal polarisation, the field lines will be oriented in a more or less orthogonal and radial configuration to the plane of the balance spring.

In order to do this, as stated above, a disc will be arranged in a parallel plane to the plane of the balance spring. FIGS. 3*a* and 3*b* are schematic, respectively cross-sectional and plan views of this arrangement, which forms a first embodiment of the invention. FIG. 3*a* shows balance spring 1 and disc 2 in cross-section. The field lines are shown at 6. A concentration of the field is noted at the periphery of disc 2, which tends to increase the field locally. This means that the disc must have a relatively large diameter compared to the diameter of balance spring 1. FIG. 3*b* is a top view and field lines 6 are those that act on balance spring 1. It is noted with respect to this Figure that there is very little radial deflection of these lines. This embodiment is the simplest and we can already see the tendency of field lines 6, picked up by disc 2, to deflect vertically. It is to be noted that if disc 2 did not exist, instead on going down onto disc 2, field line 6*a* of FIG. 3*a*, would reach balance spring 1 and magnetise its external coils in longitudinal direction L, as explained in FIG. 2.

The first embodiment that has just been described can be completed by a ring 3 mounted on disc 2 and surrounding balance spring 1. This second embodiment is shown in FIGS. 4*a* and 4*b*, which are schematic respectively cross-sectional and plan views of this second embodiment, wherein the field lines are shown at 6. While FIG. 4*b* still shows little radial deflection of the field lines, FIG. 4*a* indicates a significant increase in field lines 6*a* going down onto disc 2 and reaching balance spring 6 in the orthogonal direction Z of its coils (FIG. 2). Owing to the presence of ring 3, balance spring 1 is therefore better protected against the stray fields, a larger number of which are deviated vertically. It will be noted, however, that the concentration in the field at the periphery of disc 2 still tends to increase this field locally, hence the need to provide a disc 2 with a relatively large diameter compared to the diameter of balance spring 1.

Finally, FIGS. 5*a* and 5*b* are schematic, respectively cross-sectional and plan views of a third embodiment of the invention. The Figures show that disc 2 is fitted with a plurality of branches 4 made of the same material as the disc and arranged in the plane and periphery thereof, to form a star 5. This third embodiment is completed by the same ring 3 as in the second embodiment. The field lines are shown at 6. As for the preceding embodiment (see FIG. 5*a*), a significant increase in the verticality of the field lines is noted with the advantages described above. Moreover, FIG. 5*b* shows that field lines 6*a*, picked up by branches 4 of star 5, tend to present radially (direction R in FIG. 2) relative to the coils of balance spring 1. This third embodiment has the advantage of a considerably reduced disc 2, owing to the presence of branches 4 of star 5. This therefore results in a lighter, more compact and thus more aerated embodiment than that previously described. Furthermore, measurements have demonstrated that the standard interference effect of 4 kA/m is reduced by a factor of 6 or 7, via the device proposed. To obtain a similar effect, the simple disc 2 proposed in the first embodiment requires approximately twice as much material, which increases the mass of the device, and thus the moment of inertia and energy consumed if the device is fitted to a moving system, for example a tourbillon, whose construction will be recalled at the end of this description.

Finally, a device that uses star 5, but has no ring 2 surrounding balance spring 1, could be envisaged. This would be closer to the first embodiment described above, with a tendency of the field lines towards a radial direction but with no verticality of said lines.

We will also recall that the device of the invention protects the timepiece balance spring whatever the direction of the stray field entering said timepiece, owing to the fact that balance spring 1, disc 2, or star 5 resulting therefrom, and ring 3 are rotating parts mounted coaxially with each other. It has been seen that this is not the case of the device proposed in FR Patent No. 1,408,872 cited above.

The material with high magnetic permeability used for making ring 3, disc 2 or star 5 is soft iron or, more specifically, an AFK502 type iron-nickel alloy by Arcelormittal. According to variants, one could typically use iron-nickel-molybdenum, or iron-nickel-copper alloys.

FIG. 6 is a plan view of the third embodiment of the invention applied to a tourbillon and FIG. 7 is a cross-section along the line VII-VII of FIG. 6.

Without going into detail, it will be recalled that the tourbillon includes a conventional assortment formed by an escape wheel 10, pallets 11 and a roller 12, connected to a balance 13 and to a balance spring 1. These elements are mounted in a rotating carriage 14. Carriage 14 operates like a fourth wheel set and generally completes one revolution per minute. The carriage is secured to a fourth pinion 15 driven by a third wheel (not shown). Inside carriage 14, the role of the escapement is conventional. The force is transmitted from an escape pinion 16, which meshes, like a planetary wheel, with a stationary fourth wheel 17, secured to bottom plate 18.

In this construction, FIGS. 6 and 7 show that a star 5 and a ring 3, belonging to the present invention, have been added to protect the balance spring against stray magnetic fields. The star includes here six branches 4. All the advantages of using a star with long branches connected to the primitive disc can be seen here. Indeed, this arrangement enhances the tourbillon mechanism, which would not be the case if the star was replaced by a disc with a large diameter that concealed the mechanism.

What is claimed is:

1. A device for protecting a timepiece balance spring of an escapement mechanism from stray magnetic fields originating from outside said timepiece, wherein said escapement mechanism, comprises an escape wheel cooperating with a pallet fork for mechanically maintaining the oscillation of a balance associated to said balance spring, wherein said balance and balance spring oscillate about a common axis, wherein said oscillation are exclusively maintained by mechanical means, wherein said protecting device includes at least one disc with high magnetic permeability, arranged in a parallel plane to the plane of the balance spring, wherein the disc and the balance spring are mounted coaxially with each other and arranged so as to direct or deviate the stray magnetic fields that reach the balance spring, in the radial direction and/or in the direction of the balance spring.

2. The device according to claim 1, wherein a ring with high magnetic permeability is mounted on the disc, wherein said ring is arranged around the balance spring and coaxially therewith.

3. The device according to claim 1, wherein the disc is fitted with a plurality of branches made of the same material as the disc and arranged in the plane thereof and at the periphery thereof to form a star, said disc and said star being the same structure.

4. The device according to claim 3, wherein a ring with high magnetic permeability is mounted on the star, wherein said ring is arranged around the balance spring and coaxially therewith.

5. The device according to claim 4, wherein it is mounted in a tourbillon.

* * * * *